United States Patent [19]

Dillon

[11] 3,991,528

[45] Nov. 16, 1976

[54] MODULE ELEVATOR SYSTEM FOR INSTALLATION IN A MULTI-STORY BUILDING

[75] Inventor: Thomas J. Dillon, Akron, Ohio

[73] Assignee: FCE-Dillon, Inc., Akron, Ohio

[22] Filed: Apr. 13, 1973

[21] Appl. No.: 351,016

Related U.S. Application Data

[63] Continuation of Ser. No. 142,644, May 12, 1971, abandoned.

[52] U.S. Cl. ..... 52/79; 52/30; 52/122; 52/236; 52/259

[51] Int. Cl.[2] ..... E04H 1/00; E04H 1/04

[58] Field of Search ..... 52/259, 79, 29, 30, 52/236, 220, 122, 126, 251, 252, 260, 262

[56] References Cited

UNITED STATES PATENTS

| | | | |
|---|---|---|---|
| 742,540 | 10/1903 | Wills | 52/30 |
| 791,875 | 6/1905 | Buente | 52/259 |
| 1,998,448 | 4/1935 | Crowe | 52/220 |
| 2,003,670 | 6/1935 | Walker | 52/236 |
| 2,877,875 | 3/1959 | Bolt | 52/122 |
| 3,118,187 | 1/1964 | Alimanestiano | 52/34 |
| 3,284,966 | 11/1966 | Bolt | 52/126 |
| 3,411,252 | 11/1968 | Boyle | 52/122 |
| 3,514,910 | 6/1970 | Comm | 52/79 |
| 3,546,827 | 12/1970 | Demarais | 52/29 |
| 3,693,308 | 9/1972 | Trezzini et al. | 52/259 X |

FOREIGN PATENTS OR APPLICATIONS

| | | | |
|---|---|---|---|
| 552,897 | 2/1958 | Canada | 52/236 |
| 973,716 | 2/1951 | France | 52/259 |
| 1,965,417 | 7/1970 | Germany | 52/79 |
| 530,372 | 7/1955 | Italy | 52/236 |
| 419,527 | 3/1967 | Switzerland | 52/251 |
| 442,677 | 1/1968 | Switzerland | 52/259 |
| 416,991 | 1/1967 | Switzerland | 52/236 |
| 1,158,708 | 7/1969 | United Kingdom | 52/236 |
| 1,129,524 | 10/1968 | United Kingdom | 52/79 |

*Primary Examiner*—Price C. Faw, Jr.
*Assistant Examiner*—Leslie Braun
*Attorney, Agent, or Firm*—Reese Taylor

[57] ABSTRACT

A precast concrete module defining a combined elevator shaft and utility chase area that is one story high and stacking of the modules on top of each other during construction, resulting in a completely finished elevator shaft and utility chase at the completion of erection. By this method of construction, considerable installation time following erection is eliminated in view of the fact that many of the components are already preassembled in the module prior to lifting to location.

2 Claims, 6 Drawing Figures

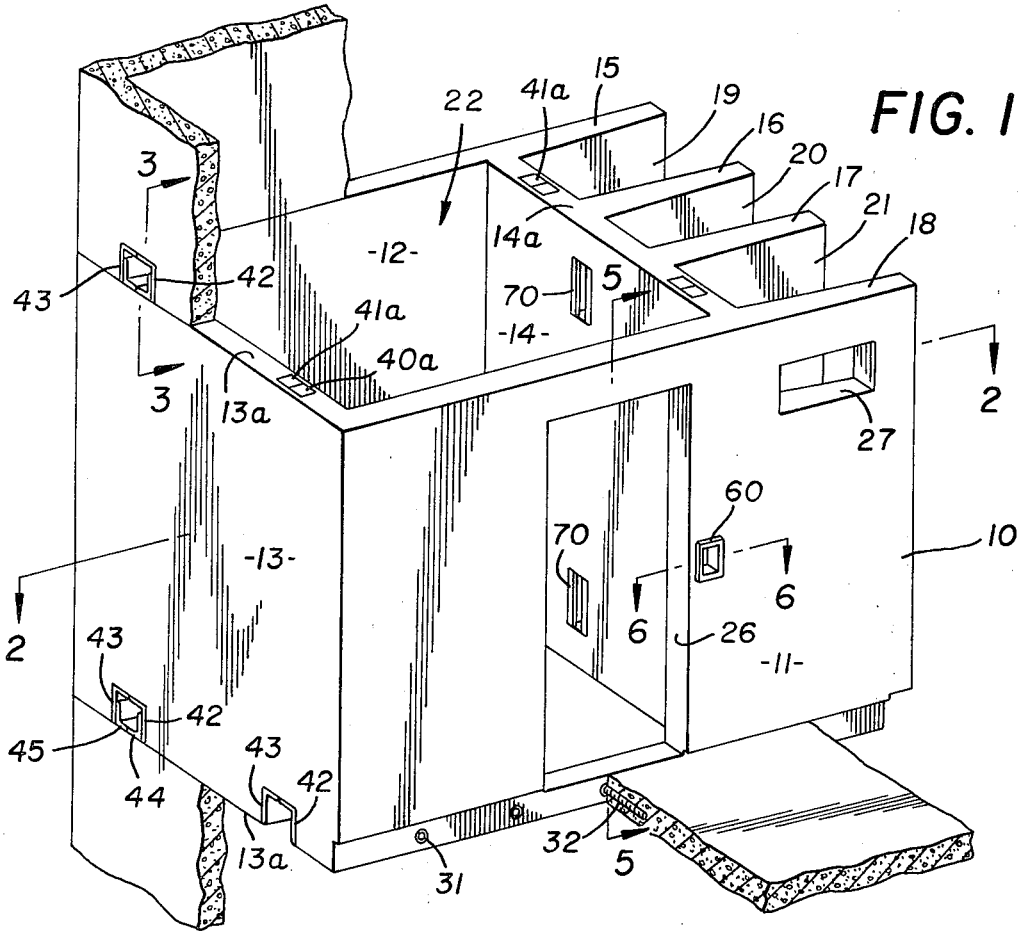
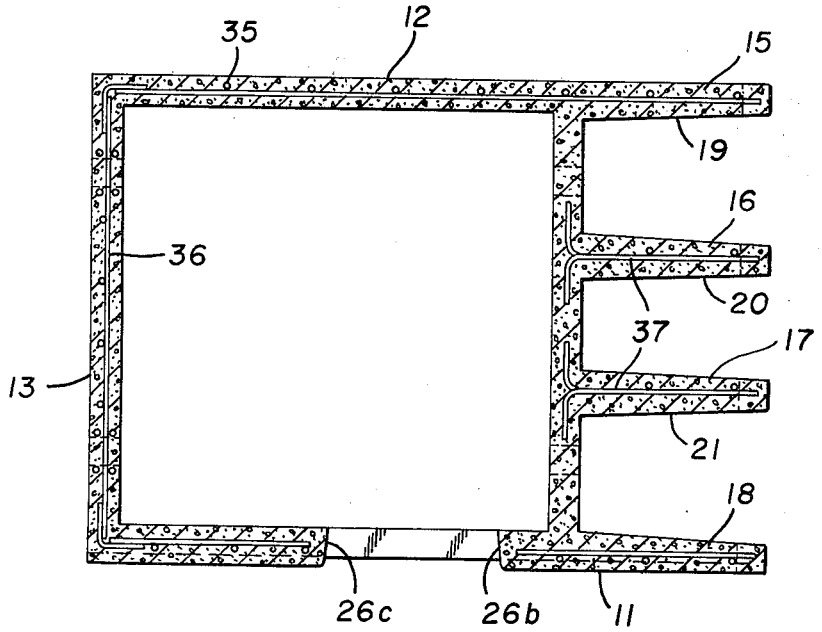
FIG. 2
INVENTOR.
THOMAS J. DILLON
BY Freeman & Taylor
ATTORNEYS

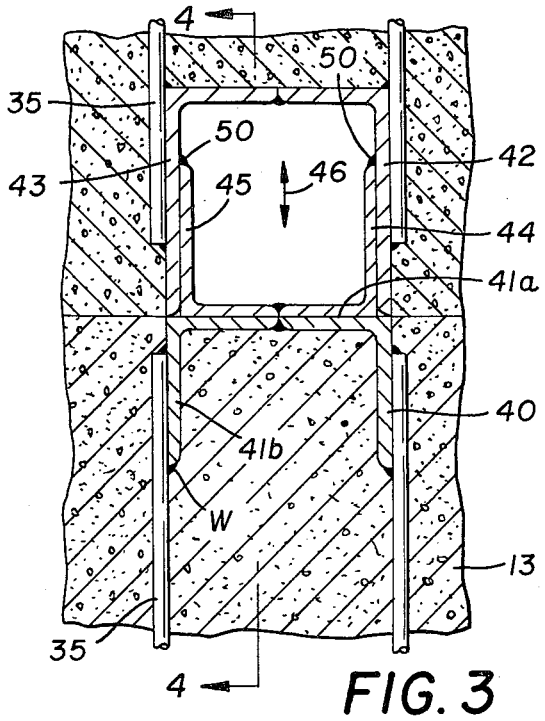
FIG. 3
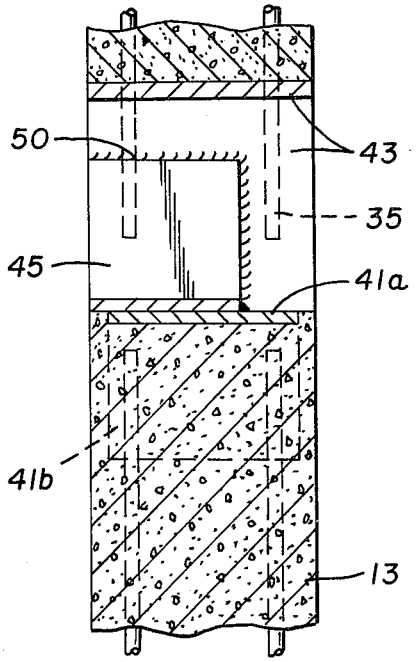
FIG. 4
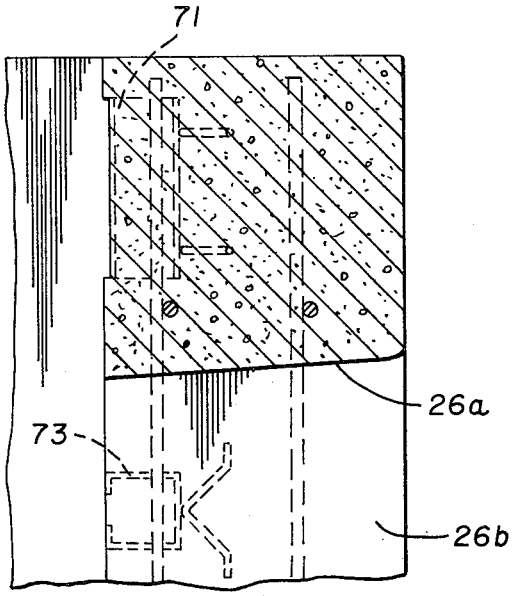
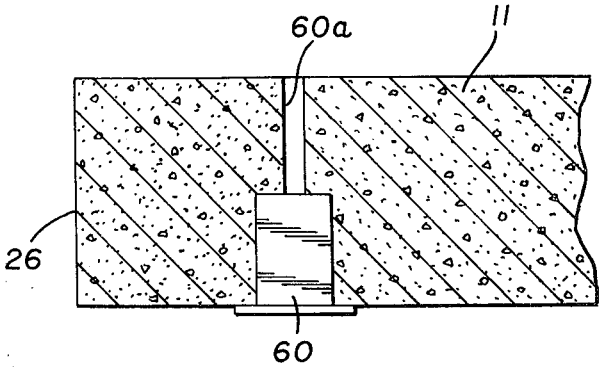
FIG. 6
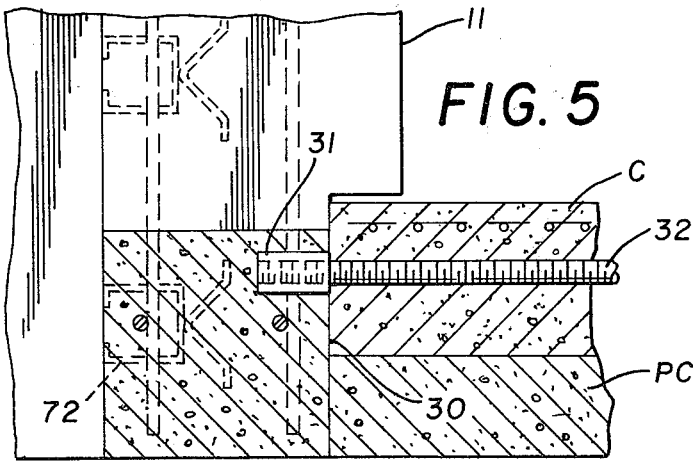
FIG. 5
INVENTOR.
THOMAS J. DILLON
BY Freeman & Taylor
ATTORNEYS

MODULE ELEVATOR SYSTEM FOR INSTALLATION IN A MULTI-STORY BUILDING

RELATED APPLICATIONS

This is a continuation of application Ser. No. 142,644, filed May 12, 1971, now abandoned.

FIELD OF THE INVENTION

This invention relates, in general, to multi-story or high-rise construction and relates in particular to a unique module capable of being formed away from the construction site and installed in place in the building and including the elevator shaft, the necessary hardware for the elevator and also utility chases.

DESCRIPTION OF THE PRIOR ART

In the art of high-rise construction wherein elevators are employed, elevator shafts and utility chases have conventionally been produced by merely leaving an opening in the floor area with the walls of the elevator and utility chases then being erected floor by floor and with the various items of hardware required for such erection being assembled or installed during erection or after the walls have been cast in place and hardened. Stated otherwise, in the past the shaft for the elevator has first been completely built as regards structural elements, and then assembly of the elevator with its associated hardware within the shaft commences.

SUMMARY OF THE INVENTION

The present invention contemplates precasting the elevator shaft and utility chases into a single unitary structure at a site preferably removed from the construction site.

The elevator module includes a shaft portion that has leveling devices associated with the top and bottom edges thereof so that complete vertical alignment of the walls and the shaft can be achieved at the time of placement of the module.

The elevator module further includes several built-in features, such as a door opening having prefinished door jamb and head sections and partially embedded steel plates, that serve to minimize the assembly time required at the finish of erecting the module. Additionally, the module includes most of the hardware necessary for installing the elevator per se including side rail brackets and side rails, door headers and door header inserts, door hanger and door hanger inserts, an electrical duct and a push-button control station box as well as sill inserts.

Production of an improved building module having the above-desired advantages accordingly becomes the principal object of this invention, with other objects of the invention becoming more apparent upon the reading of the following brief specification, considered and interpreted in view of the accompanying drawings.

OF THE DRAWINGS:

FIG. 1 is a perspective view of the improved module, with a fragmentary portion of a lower module and an upper module being illustrated in connection with the module shown in perspective.

FIG. 2 is a plan view in cross section of the module.

FIG. 3 is a vertical section taken on the lines 3—3 of FIG. 1.

FIG. 4 is a sectional view taken on the lines 4—4 of FIG. 3.

FIGS. 5 and 6 are sections taken on the lines 5—5 and 6—6 of FIG. 1.

DESCRIPTION OF THE PREFERRED EMBODIMENT

Referring now to the drawings and in particular to FIG. 1 thereof, each elevator and utility module is generally indicated by the numeral 10 and includes a front wall 11, a rear wall 12, a side wall 13, and a partition wall 14, with partition wall 14 connecting with parallel projecting flanges 15, 16, 17, and 18 so as to define three utility chases that are respectively indicated by the numerals 19, 20, and 21, with the elevator shaft being formed by walls 11, 12, 13 and 14 and being indicated generally by the numeral 22, as best shown in FIG. 1 of the drawings. Actually, the flanges 15 and 18 are merely extensions of the walls 11 and 12. For the purpose of access, the front wall 11 has a door opening 26 provided therein, while the wall of the rib member 18 includes a ventilating opening 27, as again clearly shown in FIG. 1 of the drawings.

Referring now to FIG. 5, it will be noted that the upper portion **26*a* of the door opening is provided with a smooth finish on all surfaces such as the door jamb and head that, in effect, serves as the finished door opening for the elevator unit, with the walls 26*b* and all remaining walls of the door opening 26** being similarly flared out to serve as a finished door jamb.

Also included in the precast module is a push-button control box 60 and an electrical duct **60*a* (FIG. 6) which permits ready installation of the actual controls themselves together with their associated wiring. Furthermore, the prefinished module includes a plurality of embedded channels 70,70 on the interior of walls 13 and 14, with these channels serving to support the side rails (not shown) upon which the elevator runs. In addition to these channels, channels 71, 71 are provided adjacent the opening 26 to provide support for the door header (not shown). Another series of channels 72, 72 are provided to support the door sill and finally a plurality of channels 73, 73** are embedded in the walls to provide a support for the door side rails or stops (not shown).

All of these channels are of similar configuration and provide an anchoring point for the various items of hardware just described.

Also, and again referring to FIG. 5, the lower edge of the front wall 11 is shown offset as at 30 so as to permit concrete C to be cast in place following erection to form the floor. To ensure proper connection, the lowermost portion of the wall 11 is provided with a tapped plug 31 within which may be received a threaded rod 32, with the rod projecting prior to raising of the concrete C to the level shown in FIG. 5. In this regard, it is contemplated that the floor would be precast as indicated at PC and then brought to the job site. When the module has been placed into position and the tapped plug 31 and rod 32 have been mounted, the floor would then be cast so that the concrete rises to the level shown and indicated by the letter C, thereby making the module structurally integral with the overall building.

The wall members 11, 12, 13 and 14 have the usual vertical reinforcing rods 35,35 provided therein, with these rods preferably being connected with horizontal rods 36,36 for strengthening purposes in a manner well known in the art. T-rods 37,37 are also provided, as shown in FIG. 2, for the purpose of strengthening the point of connection between the rib 16, for example, and the wall 14, as is clearly shown in the drawings.

For the purpose of imparting leveling to the modules following installation on top of each other in the manner shown, as best shown in FIGS. 1 and 3, the tops of the wall members 13 and 14 have a pair of angles 40*a* and 41*a* which are cast into the top surfaces 13*b* and 14*b* and would be welded to rods 35,35 for positioning purposes.

Again referring to FIGS. 1 and 3, the lower edges 13*a* are provided with notch-like openings within which angles 42 and 43 may be received and welded in place to each other and to rods 35,35 which hold them in place, as shown in FIG. 3 of the drawings. By this arrangement, a third pair of angles 44 and 45 may be inserted within the space between the legs of flanges 42 and 43, as shown in FIG. 2, and following this, it is merely necessary to put a jack between the flanges 42 and 43, on the one hand, and the flanges 44 and 45 on the other hand, to cause an expanding movement in the direction of the arrow 46. When the proper height has been achieved, it is merely necessary to weld the angles 44 to the member 42 and the angle 45 to the member 43, as indicated by the weld marks 50,50 (see FIGS. 3 and 4).

It is also contemplated within the scope of the invention to embed metal plates within the wall surfaces themselves so as to permit attachment of the rails prior to the lifting of the module into position at the construction site as described above with regard to channels 70,70.

In use or operation of the improved module, it will first be assumed that the module has been poured to the condition shown in FIG. 1 of the drawings. At this time, the same can be shipped as a unit to the construction site, and following arrival there, the modules are merely stacked one upon the other until the desired elevator height is obtained.

As each module is placed on the one beneath it, it is recommended that the adjusting members be welded in place so that when all of the modules have been stacked on each other, a completely plumb elevator shaft will have been erected. Following erection in the manner just described, it is believed apparent that the floor can be poured as previously described, and it will be noted that the elevator door opening is already finished, with the result that it is merely necessary to have minor assembly work following erection of the elevator modules in the manner just described.

It will be noted that simultaneously with the erection of the elevator shaft there are attained three utility chases through which the main utility supply lines may be run, with exhaust at each floor being made preferably through opening 27 of the utility chase 21.

While a full and complete description of the invention has been set forth in accordance with the dictates of the Patent Statutes, it is to be understood that the invention is not intended to be limited to the specific form herein shown.

Accordingly, modifications of the invention may be resorted to without departing from the spirit hereof or the scope of the appended claims.

What is claimed is:

1. A modular elevator system for installation in a multi-story building by means of suitable lifting apparatus, comprising;

a. a series of identical elevator modules each of which 1. is of precast concrete construction that includes internally embedded reinforcing rods,
2. includes front, back, and opposed side walls and upper and lower surfaces that form a vertical elevator shaft of at least one-story height,
3. has at least one door opening provided in the front wall portion thereof,
4. has a plurality of metal support channels embedded within and forming a part of the inside wall surfaces of said modules for rail and door supporting purposes,
5. has upper and lower vertically aligned leveling and attachment means provided on each top and bottom surface of at least two of said opposed walls; the leveling means on said top surface including first metal angle members embedded therein; the leveling means on said bottom surfaces including recesses having second metal angle members secured therein and; third metal angle members for interconnecting said first and second angle members following leveling and alignment of said modules by the lifting apparatus;
6. has means for rigidly securing said adjusted, vertically adjacent modules to each other and to adjacent floor surfaces of each floor of said building, whereby an elevator shaft consisting of vertically adjacent modules is integrally secured to said building throughout its height.

2. The modular elevator system of claim 1 further characterized by the fact that A. the lower edge of at least one said wall surface is offset inwardly in parallel relationship with the upper remaining portion of said wall surface;

B. a series of dowels are carried by said recessed surface of said wall and project outwardly therefrom at right angles to the plane thereof and to a point beyond the vertical plane of the remaining uppermost surface of said wall;

C. a precast concrete section has a longitudinal edge portion adapted to abut against said inwardly offset wall surface beneath said dowels; and D. site-poured concrete is adapted to be poured on top of said precast concrete slab to a level approximating the height of said offset surface of said wall thereby said dowels are embedded in said site-poured concrete.

* * * * *

UNITED STATES PATENT OFFICE

CERTIFICATE OF CORRECTION

Patent No. 3,991,528 Dated November 16, 1976

Inventor(s) Thomas J. Dillon

It is certified that error appears in the above-identified patent and that said Letters Patent are hereby corrected as shown below:

In Figure 1, the numbers "13a and 14a" designating the the top edges of the walls 13 and 14 should read --- 13b and 14b ---.

In Figure 3, the number "41b" should be ---41a---, and the number "40" should read ---40a---.

In Figure 4, the number "41b" should read ---41a---.

Signed and Sealed this

First Day of March 1977

[SEAL]

*Attest:*

RUTH C. MASON
*Attesting Officer*

C. MARSHALL DANN
*Commissioner of Patents and Trademarks*